US010975628B2

(12) United States Patent
Xu et al.

(10) Patent No.: US 10,975,628 B2
(45) Date of Patent: Apr. 13, 2021

(54) DRILL BIT NOZZLE AND DRILL BIT

(71) Applicant: SEED TECHNOLOGIES CORP., LTD., Hunan (CN)

(72) Inventors: Yuehua Xu, Hunan (CN); Jiaqing Yu, Hunan (CN); Weixiong Wang, Hunan (CN); Jianghe Luo, Hunan (CN); Runan Zhang, Hunan (CN)

(73) Assignee: SEED TECHNOLOGIES CORP., LTD., Hunan (CN)

( * ) Notice: Subject to any disclaimer, the term of this patent is extended or adjusted under 35 U.S.C. 154(b) by 128 days.

(21) Appl. No.: 16/155,891

(22) Filed: Oct. 10, 2018

(65) Prior Publication Data

US 2019/0345775 A1 Nov. 14, 2019

(30) Foreign Application Priority Data

May 10, 2018 (CN) ..... 201820695685.X

(51) Int. Cl.
*E21B 10/61* (2006.01)
*E21B 10/60* (2006.01)
*E21B 10/18* (2006.01)

(52) U.S. Cl.
CPC ..... *E21B 10/61* (2013.01); *E21B 10/18* (2013.01); *E21B 10/602* (2013.01)

(58) Field of Classification Search
CPC ..... E21B 10/60; E21B 10/18; E21B 10/61; E21B 41/0078; E21B 2010/607
See application file for complete search history.

(56) References Cited

U.S. PATENT DOCUMENTS 4,076,082 A * 2/1978 Baum ..... E21B 7/14 175/14
4,494,618 A * 1/1985 Radtke ..... E21B 10/61 175/393
4,688,637 A * 8/1987 Theis ..... E21B 41/0078 166/222
4,794,995 A * 1/1989 Matson ..... E21B 10/61 175/340
5,494,124 A * 2/1996 Dove ..... B05B 1/02 175/424
6,834,720 B1 * 12/2004 Dwyer ..... B09C 1/00 166/177.4
7,735,582 B2 * 6/2010 Smith ..... E21B 10/60 175/340

* cited by examiner

*Primary Examiner* — Catherine Loikith
(74) *Attorney, Agent, or Firm* — Yue (Robert) Xu; Apex Attorneys at Law, LLP

(57) ABSTRACT

A drill bit nozzle includes a nozzle body, a channel in the nozzle body, and a nozzle outlet arranged at an end of the nozzle body and in communication with the channel. The nozzle outlet is a strip-shaped outlet configured to eject a sheet-like jet flow. Since the nozzle outlet of the drill bit nozzle is a strip-shaped outlet, the nozzle outlet is able to eject a sheet-like jet flow. When the drill bit nozzle is applied to a PDC drill bit, the drill bit nozzle can uniformly eject a drilling fluid onto each cutting tooth, which ensures that the cutting teeth in the drill bit may obtain good cooling and chip removal effects, while avoiding excessive concentration of the jet flow from the drill bit nozzle which may erode the cutting teeth, thereby prolonging the service life of the drill bit.

8 Claims, 4 Drawing Sheets

DRILL BIT NOZZLE AND DRILL BIT

CROSS-REFERENCE TO RELATED APPLICATIONS

This application claims the benefit of priority to Chinese Patent Application No. 201820695685.X titled "DRILL BIT NOZZLE AND DRILL BIT", filed with the Chinese State Intellectual Property Office on May 10, 2018, the entire disclosure of which is incorporated herein by reference.

FIELD

This application relates to the technical field of mechanical design and manufacture, and in particular to a drill bit nozzle and a drill bit provided with the drill bit nozzle.

BACKGROUND

In drilling exploration engineering for petroleum and natural gas, polycrystalline diamond compact (PDC) drill bits have advantages of high mechanical drilling rate, long service life and large footage compared with roller cone drill bits, and therefore are widely used.

In the conventional technology, nozzles of conventional PDC drill bits are mostly circular, which may eject a cylindrical jet flow, and the ejection direction is relatively concentrated, therefore, the cooling and chip removal effects on the cutting teeth facing the jet flow are the best, and the cooling and chip removal effects on other cutting teeth are poor. Moreover, the concentratedly ejected cylindrical jet flow may also cause great erosion around tooth holes, which is apt to cause the cutting teeth to fall off.

In addition, in order to ensure the cooling and chip removal effects for all the cutting teeth, a nozzle of a conventional drill bit is generally arranged at a front end of a drill blade. For the cutting teeth at the front end of the drill blade, the rock cutting volume is the smallest, and the heat generation is the smallest, however, flow rates for cooling and chip removal are the largest, resulting in a low energy utilization rate of a liquid coolant. For the cutting teeth on a shoulder of the drill bit, the rock cutting volume is the largest, and the heat generation is the largest, however, the flow rate of the liquid coolant is limited at this position, such that not only the chips at this position cannot be discharged in time which may cause repeat crushing and may adversely affect the mechanical drilling rate of the drill bit, but also the wear resistance and toughness of the cutting teeth are adversely affected due to insufficient cooling, which may cause premature failure of the drill bit and may in turn adversely affect the service life of the drill bit.

Therefore, a technical issue to be addressed by those skilled in the art is to ensure that each of the cutting teeth in the drill bit can obtain good cooling and chip removal effects, while avoiding excessive concentration of the jet flow from a drill bit nozzle which may erode the cutting teeth.

SUMMARY

In view of this, an object of the present application is to provide a drill bit nozzle and a drill bit provided with the drill bit nozzle, to ensure that each of cutting teeth in the drill bit can obtain good cooling and chip removal effects, while avoiding excessive concentration of a jet flow from the drill bit nozzle which may erode the cutting teeth.

To achieve the above object, the following technical solutions are provided according to the present application.

A drill bit nozzle includes a nozzle body, a channel in the nozzle body, and a nozzle outlet arranged at an end of the nozzle body. The nozzle outlet is in communication with the channel, and the nozzle outlet is a strip-shaped outlet configured to eject a sheet-like jet flow.

Preferably, in the drill bit nozzle, the strip-shaped outlet is embodied as a strip-shaped hole configured to eject the sheet-like jet flow;

or the strip-shaped outlet is embodied as multiple outlets arranged in a strip shape and configured to eject the sheet-like jet flow.

Preferably, in the drill bit nozzle, the strip-shaped hole is an oblong hole or a rectangular hole.

Preferably, in the drill bit nozzle, the strip-shaped outlet is a straight strip-shaped outlet or a curved strip-shaped outlet.

Preferably, in the drill bit nozzle, in a cross section of the nozzle body:

an outer profile shape of the nozzle body is a straight strip shape or a curved strip shape; and a section shape of the channel is a straight strip shape or a curved strip shape.

Preferably, in the drill bit nozzle, the channel has a width greater than a width of the strip-shaped outlet.

Preferably, in the drill bit nozzle, a portion, connected to the nozzle outlet, of an inner cavity surface of the channel is a guiding surface, and the guiding surface is a flat surface or a spatial curved surface.

A drill bit includes a drill bit body, cutting teeth, and a nozzle. The cutting teeth are arranged at an outer side of the drill bit body, the nozzle configured to eject a liquid coolant to the cutting teeth is arranged in the drill bit body. The nozzle is the drill bit nozzle described above.

Preferably, in the drill bit, the nozzle is fixed in the drill bit body by brazing or sintering or a mechanical locking device.

Preferably, in the drill bit, the drill bit is a PDC drill bit, a roller cone drill bit, a PDC-roller cone composite drill bit or an impregnated drill bit.

As can be seen from the above technical solutions, in the drill bit nozzle according to the present application, the nozzle outlet is arranged in a strip shape, such that the nozzle is able to eject a sheet-like jet flow. When the drill bit nozzle is applied to a PDC drill bit, in a radial direction of the drill bit, a range that the cutting teeth covered by the ejection of the drill bit nozzle is wide, and the drill bit nozzle is able to uniformly eject a drilling fluid onto each cutting tooth. It can be seen that, the drill bit nozzle fully cools each cutting tooth, thus effectively improving the service life of the cutting teeth, and thereby improving the service life of the PDC drill bit. Moreover, chips generated by the cutting teeth can be discharged in time, to reduce a residence time of the chips in a chip removal groove, so as to avoid repeated crushing, improve an energy utilization rate, and make the chip removal more fully, thereby reducing the resistance of the drill bit, and improving the mechanical drilling rate. In addition, compared with the cylindrical jet flow in the conventional technology, the sheet-like jet flow ejected by the drill bit nozzle can avoid excessive concentration of the jet flow from the drill bit nozzle which may erode the cutting teeth.

BRIEF DESCRIPTION OF THE DRAWINGS

In order to more clearly illustrate technical solutions in embodiments of the present application or in the conventional technology, drawings referred to describe the embodiments or the conventional technology will be briefly described hereinafter. Apparently, the drawings in the following description show only some embodiments of the present application, and for those skilled in the art, other drawings may be obtained based on these drawings without any creative efforts.

Figure 1:
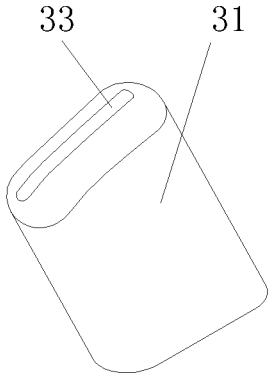
FIG. 1 is a schematic perspective view showing the structure of a drill bit nozzle according to a first embodiment of the present application.

| Reference numerals in the drawings: | | |
|---|---|---|
| 1 cutting tooth, | 2 drill bit body, | 3 nozzle, |
| 31 nozzle body, | 32 channel, | |
| 33 nozzle outlet, | 321 guiding surface. | |

DETAIL DESCRIPTION OF EMBODIMENTS

The present application discloses a drill bit nozzle and a drill bit provided with the drill bit nozzle, which can ensure that all cutting teeth in the drill bit can obtain good cooling and chip removal effects, while avoiding excessive concentration of a jet flow from the drill bit nozzle which may erode the cutting teeth.

The technical solutions in the embodiments of the present application will be clearly and completely described in conjunction with drawings in the embodiments of the present application. Apparently, the embodiments described below are only a part rather than all of the embodiments of the present application. All other embodiments obtained by those skilled in the art based on the embodiments in the present application without creative efforts fall within the protection scope of the present application.

Figure 2:
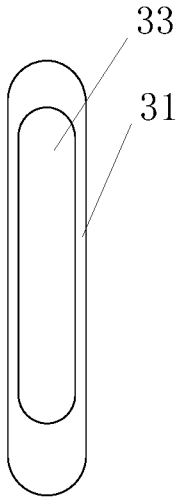
FIG. 2 is a top view of a straight strip-shaped drill bit nozzle according to the first embodiment of the present application.
Figure 3:
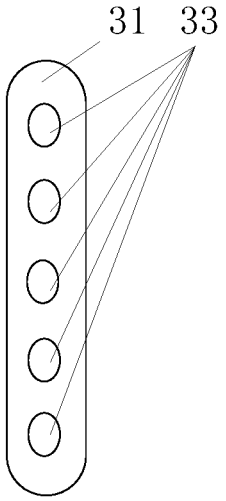
FIG. 3 is a top view of a straight strip-shaped drill bit nozzle according to a second embodiment of the present application.
Figure 4:
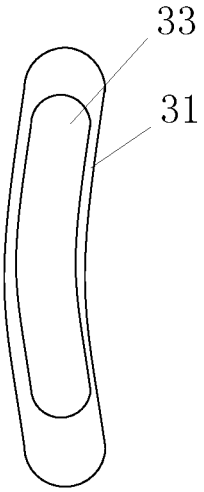
FIG. 4 is a top view of a curved strip-shaped drill bit nozzle according to a third embodiment of the present application.
Figure 5:
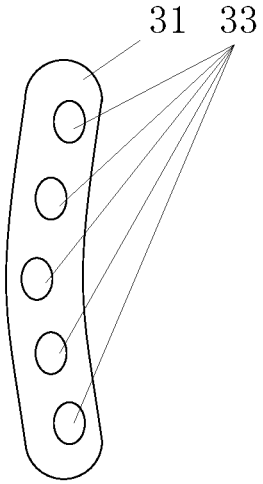
FIG. 5 is a top view of a curved strip-shaped drill bit nozzle according to a fourth embodiment of the present application.
Figure 6:
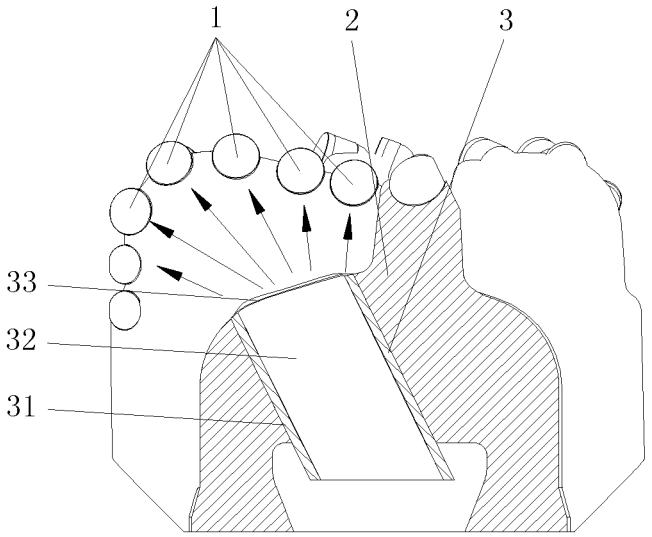
FIG. 6 is a sectional view of a drill bit according to a fifth embodiment of the present application.
Figure 7:
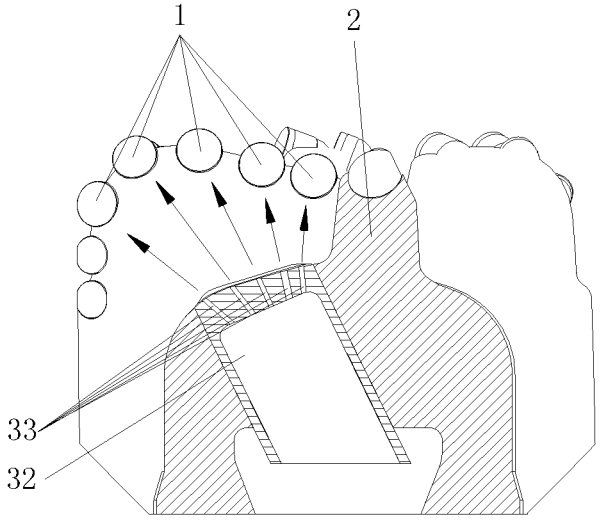
FIG. 7 is a sectional view of a drill bit according to a sixth embodiment of the present application.
Figure 8:
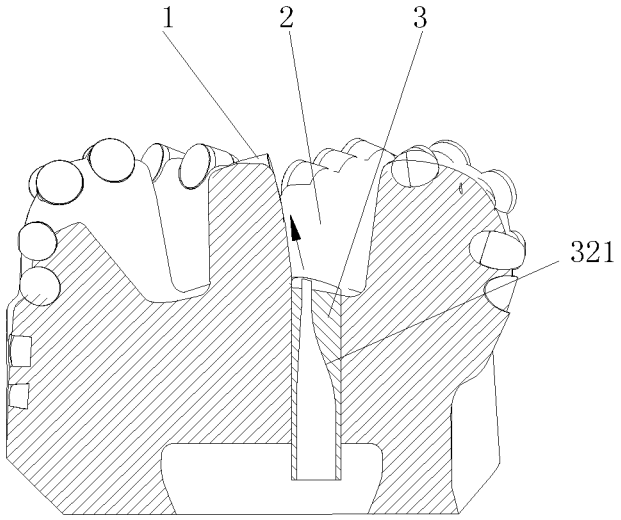
FIG. 8 is a cross-sectional side view of a drill bit according to a fifth embodiment of the present application.

FIG. 1 is a schematic perspective view showing the structure of a drill bit nozzle according to a first embodiment of the present application; FIG. 2 is a top view of a straight strip-shaped drill bit nozzle according to the first embodiment of the present application; FIG. 3 is a top view of a straight strip-shaped drill bit nozzle according to a second embodiment of the present application; FIG. 4 is a top view of a curved strip-shaped drill bit nozzle according to a third embodiment of the present application; FIG. 5 is a top view of a curved strip-shaped drill bit nozzle according to a fourth embodiment of the present application; FIG. 6 is a sectional view of a drill bit according to a fifth embodiment of the present application; FIG. 7 is a sectional view of a drill bit according to a sixth embodiment of the present application; and FIG. 8 is a cross-sectional side view of a drill bit according to a fifth embodiment of the present application.

The drill bit nozzle according to the first embodiment of the present application includes a nozzle body 31, a channel 32 in the nozzle body 31, and a nozzle outlet 33 arranged at an end of the nozzle body 31. The nozzle outlet is in communication with the channel 32, and the nozzle outlet 33 is a strip-shaped outlet which can eject a sheet-like jet flow (the "sheet-like", "strip-shaped" both refer to a narrow and long structure). Specifically, the above "strip-shaped outlet" may refer to one outlet, and may also include multiple outlets.

For example, as shown in FIGS. 1 and 2, in the first embodiment according to the present application, in the case that the nozzle outlet 33 of the drill bit nozzle is configured as one outlet, the nozzle outlet 33 is a strip-shaped hole for ejecting a sheet-like jet flow, and the ejecting effect thereof is shown in FIG. 6. The strip-shaped hole refers to a narrow and long through hole, such as an oblong hole, an elliptical hole, a rectangular hole, or other strip-shaped holes capable of forming a sheet-like jet flow. The strip-shaped hole may be of an axisymmetric structure or a non-axisymmetric structure, which is not specifically limited by the present application.

For example, as shown in FIG. 3, in the second embodiment according to the present application, in the case that the nozzle outlet 33 of the drill bit nozzle is configured as multiple outlets, the nozzle outlet 33 is embodied as multiple outlets arranged in a strip shape (or arranged side by side) for ejecting a sheet-like jet flow, and the ejecting effect thereof is shown in FIG. 7. When the drill bit nozzle of this structure is applied to a PDC drill bit, each of the outlets corresponds to one cutting tooth or multiple cutting teeth on a drill blade, and the size of each of the outlets is determined according to a flow quantity required by the cooling and chip removal of the corresponding cutting teeth. During operation, the multiple outlets in the nozzle outlet 33 not only have a wider covering area, but also may eject a corresponding drilling fluid in a targeted manner according to a rock cutting amount and a heat generation amount of each cutting tooth, to achieve the best cooling and chip removal effects.

As can be seen from the above technical solution that, since the nozzle outlet 33 of the drill bit nozzle is a strip-shaped outlet, the drill bit nozzle is able to eject a sheet-like jet flow. When the drill bit nozzle is applied to a PDC drill bit, in a radial direction of the drill bit, a range that the cutting teeth covered by the ejection of the drill bit nozzle is wide, and the drill bit nozzle is able to uniformly eject the drilling fluid onto each cutting tooth.

It can be seen that, the drill bit nozzle fully cools each cutting tooth, thus effectively improving the service life of the cutting tooth, and thereby improving the service life of the PDC drill bit. Moreover, chips generated by the cutting teeth can be discharged in time, to reduce a residence time of the chips in a chip removal groove, so as to avoid repeated crushing, improve an energy utilization rate may be improved, and make the chip removal more fully, thereby reducing the resistance of the drill bit, and improving a mechanical drilling rate. In addition, compared with the cylindrical jet flow in the conventional technology, the sheet-like jet flow ejected by the drill bit nozzle can avoid excessive concentration of the jet flow from the drill bit nozzle which may erode the cutting teeth.

The nozzle outlet 33 of the drill bit nozzle may be a straight strip-shaped outlet with a straight central axis, or a curved strip-shaped outlet with a curved central axis.

For example, as shown in FIGS. 2 and 3, in the first and second embodiments according to the present application, the nozzle outlet 33 of the drill bit nozzle is a straight strip-shaped outlet. In this case, the nozzle body 31 and the channel 32 are also correspondingly configured to be a flat structure with a straight strip-shaped cross section, that is, in a cross section of the nozzle body 31, an outer profile shape of the nozzle body 31 is a straight strip shape, and a cross-sectional shape of the channel 32 is also a straight strip shape.

For example, as shown in FIGS. 4 and 5, in the third and fourth embodiments according to the present application, the nozzle outlet 33 of the drill bit nozzle is a curved strip-shaped outlet. In this case, the nozzle body 31 and the channel 32 are also correspondingly configured to be a flat structure with a curved strip-shaped cross section, that is, in a cross section of the nozzle body 31, an outer profile shape of the nozzle body 31 is a curved strip shape, and a cross-sectional shape of the channel 32 is also a curved strip shape.

In summary, in a specific embodiment, the nozzle outlet 33 at a top of the drill bit nozzle may be one outlet or be composed of multiple outlets, and may be a straight strip-shaped outlet with a straight central axis, or a curved strip-shaped outlet with a curved central axis. As shown in FIGS. 2 and 4, in the case that the nozzle outlet 33 is a strip-shaped hole, the central axis of the strip-shaped hole is a straight line (that is, the nozzle outlet is a "straight strip-shaped outlet") or a curved line (that is, the nozzle outlet is a "curved strip-shaped outlet"). In the case that the nozzle outlets 33 are multiple outlets distributed side by side, a line connecting the points where the multiple outlets are distributed is a straight line (thereby the straight strip-shaped outlet with the straight central axis is formed) or a curved line (thereby the curved strip-shaped outlet with the curved central axis is formed).

Further, as shown in FIG. 8, in the above drill bit nozzle, a width of the channel 32 is greater than a width of the strip-shaped outlet in the nozzle outlet 33, so as to better eject a sheet-like jet flow. A portion, connected to the nozzle outlet 33, of an inner cavity surface of the channel 32 is a guiding surface 321, and the guiding surface 321 is configured to gradually transition the width of the channel 32 to the width of the nozzle outlet 33 and cause the drilling fluid to be precisely ejected onto the PDC cutting teeth. Specifically, the guiding surface 321 may be a flat surface or a spatial curved surface, thereby the channel 32 is formed into a structure with a wide lower portion and a narrow upper portion.

A width of the strip-shaped outlet in the nozzle outlet 33 is determined according to a flow quantity required by the cutting teeth on the drill bit. The specific shape of the strip-shaped outlet in the nozzle outlet 33 is determined according to relative positions of the cutting teeth on the drill bit and the nozzle.

In summary, referring to FIGS. 6 and 8, a drill bit is further provided according to a fifth embodiment of the present application. The drill bit includes a drill bit body 2, cutting teeth 1 and a nozzle 3, the cutting teeth 1 are arranged at an outer side of the drill bit body 2, and the nozzle 3 configured to eject a liquid coolant to the cutting teeth 1 is arranged in the drill bit body. The nozzle 3 is the above drill bit nozzle of which the outlet is a strip-shaped hole configured to eject a sheet-like jet flow. Specifically, the nozzle 3 is fixed in the drill bit body 2 by brazing or sintering, but the mounting manner is not limited thereto, and a bolt connection or other mechanical locking devices may also be applicable.

In addition, referring to FIG. 7, a drill bit is also provided according to a sixth embodiment of the present application, the structure of the drill bit according to the sixth embodiment is substantially similar to that of the fifth embodiment, except that in the sixth embodiment, a nozzle 3 is a drill bit nozzle composed of multiple outlets arranged in a strip shape as described above.

In the process of specific implementation, the drill bit according to the present application may be a PDC drill bit, a roller cone drill bit, a PDC-roller cone composite drill bit or an impregnated drill bit.

Finally, it should be further noted that, the terms such as "first", "second" and the like are merely used to distinguish an entity or an operation from another entity or operation without necessarily requiring or implying that there are any such actual relationships or sequences between these entities or operations herein. Moreover, terms "include", "comprise" or any other variations thereof are intended to encompass non-exclusive inclusion, thus a process, a method, an object, or a device including a series of elements not only include those elements, but also include other elements not explicitly listed, or also include inherent elements of the process, the method, the object, or the device. Without more limitations, an element defined by a sentence "include one . . . " does not exclude a case that there are other identical elements in the process, the method, the object, or the device including the described element.

The embodiments of the present application are described in a progressive manner. Each of the embodiments is mainly focused on describing its difference from other embodiments, and references may be made among these embodiments with respect to the same or similar portions among these embodiments.

Based on the above description of the disclosed embodiments, the present application may be implemented or used by those skilled in the art. Various modifications made to these embodiments are apparent for those skilled in the art. The general principle defined in the present application may be implemented in other embodiments without departing from spirit or scope of the present application. Therefore, the present application is not limited to the embodiments described in the present application, but should be defined by the broadest scope consistent with principles and novel features disclosed herein.

The invention claimed is:

1. A drill bit nozzle, comprising:

a nozzle body;

a channel in the nozzle body; and a nozzle outlet arranged at an end of the nozzle body, wherein the nozzle outlet is in communication with the channel, and the nozzle outlet is a long and narrow strip-shaped outlet configured to eject a sheet-like jet flow; wherein the strip-shaped outlet is embodied as a plurality of outlets arranged in a curved strip shape;

an outer profile shape of the nozzle body is a curved strip shape; and a cross-sectional shape of the channel is a curved strip shape.

2. The drill bit nozzle according to claim 1, wherein the channel has a width greater than a width of the strip-shaped outlet.

3. The drill bit nozzle according to claim 2, wherein a portion, connected to the nozzle outlet, of an inner cavity surface of the channel is a guiding surface, and the guiding surface is a flat surface or a spatial curved surface.

4. A drill bit, comprising a drill bit body, cutting teeth and a nozzle, wherein:

the cutting teeth are arranged at an outer side of the drill bit body, the nozzle configured to eject a liquid coolant to the cutting teeth is arranged in the drill bit body, and the nozzle is the drill bit nozzle according to claim 1.

5. The drill bit according to claim 4, wherein the drill bit nozzle is fixed in the drill bit body by brazing or sintering or a mechanical locking device.

6. The drill bit according to claim 4, wherein the drill bit is a polycrystalline diamond compact drill bit, a roller cone drill bit, a polycrystalline diamond compact-roller cone composite drill bit or an impregnated drill bit.

7. A drill bit, comprising a drill bit body, cutting teeth and a nozzle, wherein:

the cutting teeth are arranged at an outer side of the drill bit body, the nozzle configured to eject a liquid coolant to the cutting teeth is arranged in the drill bit body, and the nozzle is the drill bit nozzle according to claim 2.

8. A drill bit, comprising a drill bit body, cutting teeth and a nozzle, wherein:

the cutting teeth are arranged at an outer side of the drill bit body, the nozzle configured to eject a liquid coolant to the cutting teeth is arranged in the drill bit body, and the nozzle is the drill bit nozzle according to claim 3.

* * * * *